United States Patent [19]

Gioia et al.

[11] 3,940,824

[45] Mar. 2, 1976

[54] PAINT TRAY AND CONTAINER APPARATUS

[76] Inventors: Charles J. Gioia; Mario Gioia, both of 1132 N. Main St., Jamestown, N.Y. 14701

[22] Filed: Jan. 6, 1975

[21] Appl. No.: 538,433

[52] U.S. Cl. ..... 15/257.06; 248/210; 248/226 E

[51] Int. Cl.[2] ..... B44D 3/12; E06C 7/14

[58] Field of Search ..... 15/257.06; 220/1 R; 248/210, 211, 226 E

[56] References Cited

UNITED STATES PATENTS

| | | | |
|---|---|---|---|
| 2,439,185 | 4/1948 | Patt | 248/210 |
| 3,394,425 | 7/1968 | Welt | 15/257.06 |
| 3,474,996 | 10/1969 | Stamm | 248/226 E X |
| 3,707,242 | 12/1972 | Golden | 15/257.06 |
| 3,738,601 | 6/1973 | Gehringer | 248/210 |
| 3,850,298 | 11/1974 | Jolly | 15/257.06 |

FOREIGN PATENTS OR APPLICATIONS

| | | | |
|---|---|---|---|
| 1,117,398 | 2/1956 | France | 15/257.06 |
| 779,845 | 1/1935 | France | 248/210 |

*Primary Examiner*—Daniel Blum
*Attorney, Agent, or Firm*—Alan N. McCartney

[57] ABSTRACT

A combination paint tray and container therefore, wherein the tray is attached to the upper edge of one side of the container with the tray and the open end of the container forming an incline with respect to the upstanding sides of the container. The bottom of the tray has mounted thereon a hook adapted to mate with the rung of a ladder and the side of the container facing the bottom side of the tray includes an arm supported and adapted to be adjustably extended so that one end may be connected to the side of the container and the other end includes a hooked portion also adapted to be engaged with another rung of a ladder. The hooked portions on both the tray and the arm extending from the side of the container are formed to provide a positive engagement with the rungs of the ladder in a manner such that the tray and container are in a relatively secure position on the ladder.

2 Claims, 3 Drawing Figures

PAINT TRAY AND CONTAINER APPARATUS

BACKGROUND OF THE INVENTION

This invention relates generally to painting apparatus, and more particularly to an improved paint tray and container apparatus specifically adapted for use in roller painting.

The use of rollers for painting has become widespread and it is generally accepted as being the most economical and practical way to apply paint to a surface in many situations. In most cases, the paint is poured from a paint can into a slanted tray wherein the paint is contained in the lower portion of the tray and is taken up by the roller and smoothed out on the roller in the slanted upward portion of the tray and from thence the paint is applied by the roller to the surface to be painted. However, most of these paint trays are not adapted for holding a large supply of paint. When excess paint is contained in the tray, it often results in an uneven distribution of the paint on the roller, since the excess paint overflows onto the slanted portion of the tray which portion is needed to evenly distribute the paint on the roller. This leads to an uneven application of the paint to the surface to be covered.

Furthermore, the present paint trays for roller application are extremely difficult to use when painting from a ladder. In fact they are almost impossible to use when painting from a straight, runged ladder. This is due to the fact that it is extremely difficult, if not impossible, to support the tray on the ladder unless a special type of platform is used on which the tray rests. This entails a great deal of inconvenience to the painter, and in many instances, severely limits the ability of the painter to use a roller to apply paint. Also in moving the painting apparatus from one location to another, it may be necessary to dismantle, at least in part, the special support mechanism and then reassemble it at the next location in which the ladder and painting apparatus is placed. This, of course, is both cumbersome and uneconomical.

OBJECTS AND SUMMARY OF THE INVENTION

Accordingly, it is the principal object of this invention to provide an improved paint tray and container apparatus which overcomes the foregoing disadvantages of the prior art.

A more particular object of the invention is to provide an improved roller-paint tray and container therefore adapted to hold a large supply of paint.

Still another object of the present invention is to provide an improved roller-paint tray and container apparatus adapted to be utilized when painting from a runged ladder.

Yet another object of the present invention is to provide an improved roller-paint tray and container adapted to be used when painting from a runged ladder and adjustable to compensate for the varying slant the ladder may have against a support surface.

The foregoing and other objects and advantages of the present invention are accomplished according to one aspect thereof through the use of a combination tray and container wherein the tray portion is attached to the upper edge of one side of the container and the tray and open top of the container form a slanted plane with respect to the upstanding sides of the container. On the bottom side of the tray is contained a hook adapted to mate with rung of the ladder and on the side of the container generally facing the bottom side of the tray is an arm supported and adapted to be adjustably extended therefrom having one end connected to the side of the container and the other end containing a hooked portion also adapted to be engaged with the rung of the ladder. The hooked portions on both the tray and the arm extending from the side of the container are formed to provide a positive engagment with the rungs of the ladder, thereby maintaining the tray and container in relatively secure position on the ladder.

According to a more specific embodiment of the invention there is provided a screen member adapted to be fitted into the tray portion of the apparatus which is operative to provide an even distribution of the paint on the roller.

DESCRIPTION OF THE PREFERRED EMBODIMENT

For a better understanding of the present invention together with further and other objects thereof, reference is had to the following detailed description of the preferred embodiments taken in conjunction with the above described drawings.

Figure 1:
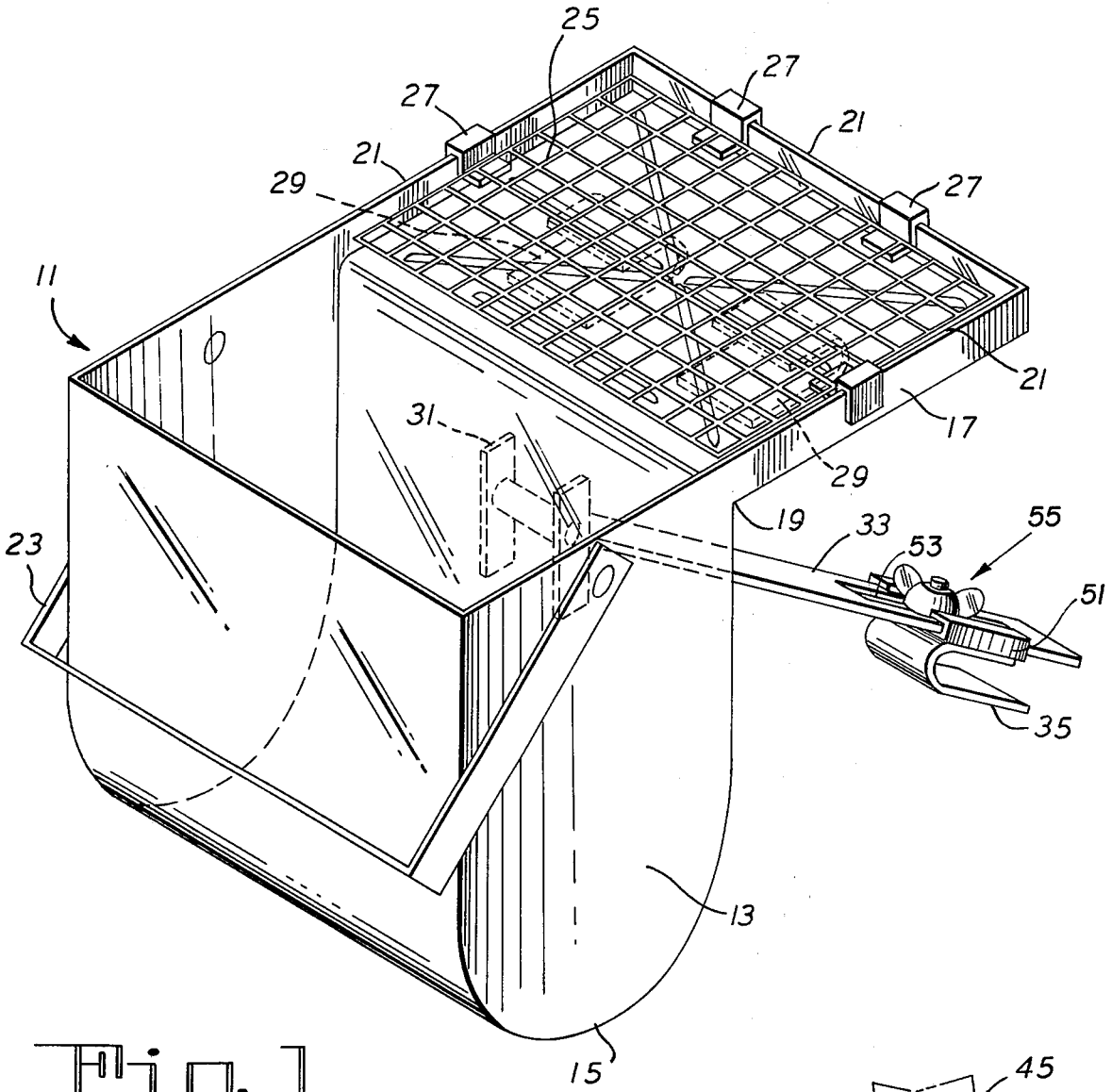
FIG. 1 is a perspective elevational view of the apparatus according to the present invention.

Referring first to FIG. 1, the apparatus 11 includes a container portion 13 having a generally rectangular cross-section which is open at the top and a generally rounded bottom portion 15. Attached to and what may be a part of the top of the container section is a tray member 17 which is attached to one edge of 19 of the container 13 to form a unitary tray and container. The tray/container apparatus is formed so that there are upstanding sides 21 around the outer perimeter of the tray except for that edge of the tray attached to the edge 19 of the container. Suitably attached toward the top of the container member is a handle 23 which is movably mounted and adapted to be placed in a raised position to facilitate carrying of the apparatus. Fitted into the top of the tray member 17 is a screen structure 25 comprised of a generally screen like material having suitable fastening members 27 mounted at the edge thereof and adapted to be secured over the upstanding edges 21 of the tray 17. Located on the under side tray are a pair of hook members 29, suitably formed to fit, for example, over the rung of a ladder. Mounted on the back side of the container 13 is a bracket 31 adapted to support a movable arm 33 to which is attached a movable hook member 35. This ladder hook member is also formed to fit over the rung of a ladder.

Figure 2:
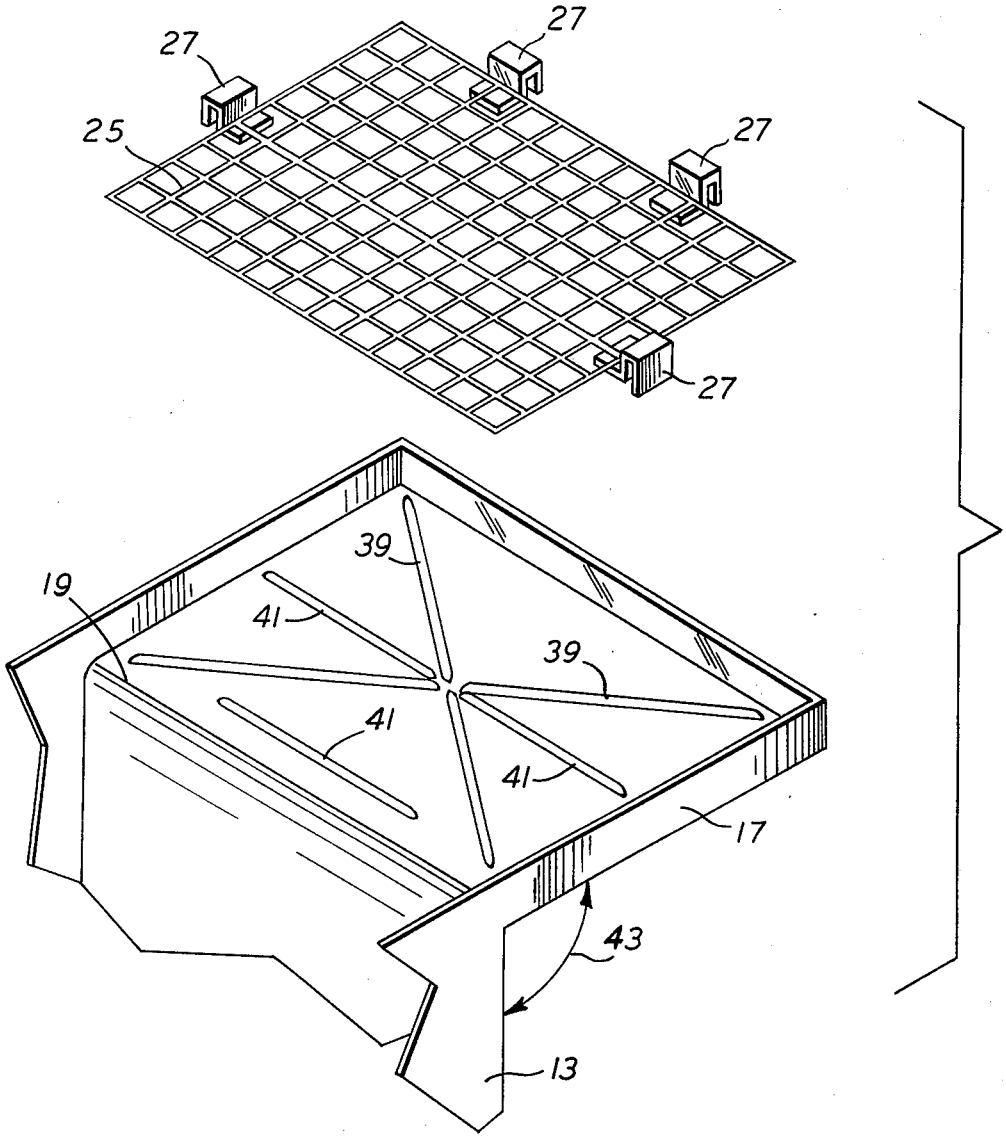
FIG. 2 is a partial perspective elevational view of the tray portion of the apparatus according to the present invention with the screen member to be inserted thereover.

Referring next to FIG. 2 there is shown an elevational view of the screen 25 and its support hooks 27 removed from the tray member 17. In situations where it would not be desirable to use the screen member 25, the top of the tray 17 can have suitably formed in it raised cross ribbed portions 39 and lateral ribbed portions 41 operative to enable a smooth distribution of paint on a roller, for example. In FIG. 2 it can also be said that according to a preferred embodiment the angle 43 between the underside of the tray 17 and the rear wall of the container 13 is an obtuse angle of, for example, between 95° and 120°.

Figure 3:
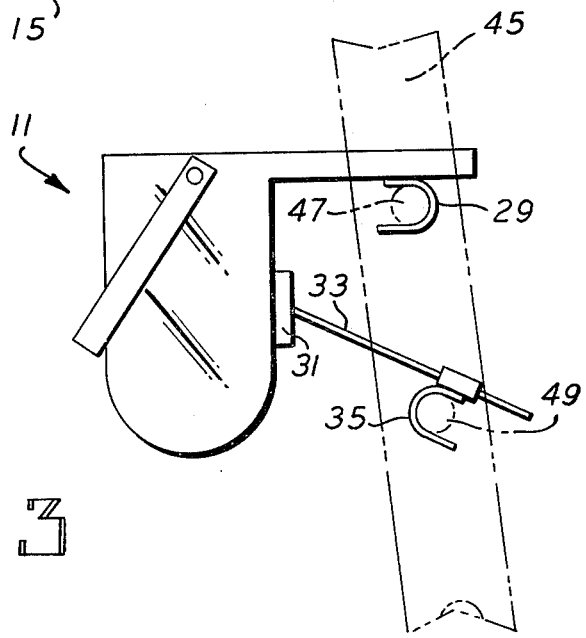
FIG. 3 is a side view partially fragmented of the apparatus according to the invention illustrating the manner in which it is suspended from a ladder.

Referring now to FIG. 3, there is illustrated the manner in which the container 11 is adapted to be mounted on a fixture such as a ladder 45. The upper hook members 29 mounted on the underside of the tray 17 are engaged with a first rung 47 of the ladder 45 and the member 35 on the arm 33 engages a lower rung 49 on the ladder. By varying the position of the adjustable member 35 on the arm 33, the angle between the tray and the ladder can be varied depending on personal preference. The adjustable member 35 is U-shaped and has side portions 51 engaging the edges and face of arm 33. The arm 33 has an elongated opening 53 which receives wing nut and bolt 55 which adjustably secures member 35 in the desired position along opening 53 to vary the disposition of the tray/container on the ladder.

As can be best seen in FIG. 3, the apparatus 11 is formed so that the weight of the apparatus operating through the hook members 29 and 35, provides a positive engagment on the rungs of the ladder, because of the purely gravitational forces that exist. This, of course, assures that the apparatus will remain in relatively fixed engagment with the rungs of the ladder in a stable configuration.

While the foregoing invention has been fully described by way of preferred embodiments, it is noted that various changes and modifications will be apparent to those of ordinary skill in the art and, therefore, the present invention is understood to be not limited by the specific details of the foregoing preferred embodiments, but rather embrace the full scope of the following claims.

What is claimed is:

1. An improved tray and container apparatus comprising:

a. a container section having a generally rectangular cross-section with an open top and a generally round bottom;

b. a tray portion integrally formed to one edge of the open top portion of said container section and extending away from said container section at an obtuse angle to form a unitary unbroken connection between the tray portion and container section;

c. said tray portion being of rectangular crosssection and having upstanding side portions merging into the open top of said container section;

d. elongated hook means disposed on the underside of said tray portion inwardly from said upstanding side portions and said integral connection of said tray portion and said container section;

e. said elongated hook means having its hook portion facing toward said container section;

f. a bracket secured to the back side of said container section below the integral connection between said tray portion and said container section and disposed medially of said elongated hook means;

g. an elongated arm movably attached to said bracket and extending outwardly from the back side of said container section and extending beyond the tray portion;

h. a movable hook member adjustably carried on said elongated arm and having its open hook portion facing in a direction opposite said elongated hook means;

i. a handle member secured to the top portion of said container section enabling the tray and container user to easily transport the entire apparatus and to permit disposition of said elongated hook means on an upper ladder rung and said movable hook member on a lower ladder rung.

2. The tray and container apparatus of claim 1 wherein a screen is carried in said tray portion disposed above the tray surface to facilitate smooth distribution of material on a paint roller.

* * * * *